US010325434B2

(12) United States Patent
Finlayson et al.

(10) Patent No.: US 10,325,434 B2
(45) Date of Patent: Jun. 18, 2019

(54) OPTICAL IDENTIFICATION SYSTEM

(71) Applicant: QINETIQ LIMITED, Farnborough, Hampshire (GB)

(72) Inventors: Ewan David Finlayson, Malvern (GB); Christopher Robert Lawrence, Farnborough (GB); Ian Richard Hooper, Exeter (GB); John Roy Sambles, Crediton (GB)

(73) Assignee: QINETIQ LIMITED (GB)

( * ) Notice: Subject to any disclaimer, the term of this patent is extended or adjusted under 35 U.S.C. 154(b) by 142 days.

(21) Appl. No.: 15/510,938

(22) PCT Filed: Oct. 1, 2015

(86) PCT No.: PCT/EP2015/072668
§ 371 (c)(1),
(2) Date: Mar. 13, 2017

(87) PCT Pub. No.: WO2016/055342
PCT Pub. Date: Apr. 14, 2016

(65) Prior Publication Data

US 2017/0239974 A1 Aug. 24, 2017

(30) Foreign Application Priority Data

Oct. 7, 2014 (GB) ..... 1417711.7

(51) Int. Cl.
*G07D 7/004* (2016.01)
*B42D 25/324* (2014.01)
(Continued)

(52) U.S. Cl.
CPC ..... *G07D 7/004* (2013.01); *B42D 25/21* (2014.10); *B42D 25/23* (2014.10); *B42D 25/29* (2014.10);
(Continued)

(58) Field of Classification Search
CPC G07D 7/00; G07D 7/004; G07D 7/04; G07D 7/12; B42D 25/21; B42D 25/23;
(Continued)

(56) References Cited

U.S. PATENT DOCUMENTS 5,032,003 A 7/1991 Antes
5,621,515 A 4/1997 Hoshino et al.
(Continued)

FOREIGN PATENT DOCUMENTS

EP 2056238 6/2009
GB 2235287 2/1991
(Continued)

OTHER PUBLICATIONS

Radić, "Algorithm for the determination of intrinsic optical constants of metal films: application to aluminium", Applied Optics, vol. 34, No. 22, pp. 4755-4767, Aug. 1, 1995.
(Continued)

*Primary Examiner* — Hina F Ayub
*Assistant Examiner* — Amanda Merlino
(74) *Attorney, Agent, or Firm* — McDonnell Boehnen Hulbert & Berghoff LLP

(57) ABSTRACT

A system and method of using the same, wherein the system comprises: an optical surface having a diffractive image generating structure disposed thereon, the diffractive image generating structure itself comprising a layer of reflective material incorporating a plurality of grooved diffractive elements each having a periodic wave surface profile, the periodic wave surface profiles each having a groove alignment direction; a source of incident electromagnetic radiation arranged to illuminate the diffractive elements at an angle of incidence substantially normal to the plane of the surface of the diffractive elements; means for polarizing the radiation from the source, and means for polarizing radiation
(Continued)

reflected from the diffractive elements; wherein the diffractive elements are configured such that, in use, polarization conversion of the incident radiation takes place, and wherein the diffractive elements are disposed in a two dimensional array of pixels to represent an image; and further wherein the means for polarizing is arranged to pass incident radiation having a polarization state of approximately 45° azimuth to the groove alignment direction, and is arranged to select a polarization, using the means for polarizing the radiation reflected from the diffractive elements, and to pass radiation of the selected polarization to a detection point.

19 Claims, 5 Drawing Sheets

(51) Int. Cl.

| | |
|---|---|
| ***B42D 25/373*** | (2014.01) |
| ***G07D 7/00*** | (2016.01) |
| ***G07D 7/04*** | (2016.01) |
| ***G07D 7/12*** | (2016.01) |
| ***B42D 25/328*** | (2014.01) |
| ***B42D 25/391*** | (2014.01) |
| ***B42D 25/21*** | (2014.01) |
| ***B42D 25/23*** | (2014.01) |
| ***B42D 25/29*** | (2014.01) |

(52) U.S. Cl.
CPC ..... *B42D 25/324* (2014.10); *B42D 25/328* (2014.10); *B42D 25/373* (2014.10); *B42D 25/391* (2014.10); *G07D 7/003* (2017.05); *G07D 7/04* (2013.01); *G07D 7/12* (2013.01)

(58) Field of Classification Search
CPC .... B42D 25/29; B42D 25/324; B42D 25/328; B42D 25/373; B42D 25/391
See application file for complete search history.

(56) References Cited

U.S. PATENT DOCUMENTS

| | | | | |
|---|---|---|---|---|
| 7,833,610 | B2 | 11/2010 | Lawrence et al. | |
| 8,910,859 | B2 | 12/2014 | Massicot et al. | |
| 2004/0240006 | A1* | 12/2004 | Staub ..... | G06K 19/06046 359/2 |
| 2010/0245771 | A1 | 9/2010 | Huang | |

FOREIGN PATENT DOCUMENTS

| | | |
|---|---|---|
| JP | 2003-122234 | 4/2003 |
| WO | WO 1990/07133 | 6/1990 |
| WO | WO 1994/28444 | 12/1994 |
| WO | WO 1998/23979 | 6/1998 |
| WO | WO 1998/37514 | 8/1998 |
| WO | WO 2012/171061 | 12/2012 |

OTHER PUBLICATIONS

Lawrence & Treen, "Polarisation conversion at a textured surface", IEE Proc. Microw Antennas Prop, vol. 146, No. 4, Aug. 1999.
Bristow et al, "Polarization conversion in the reflectivity properties of photonic crystal waveguides", IEEE Journal of Quantum Electronics, vol. 38, No. 7, Jul. 2002.

* cited by examiner

OPTICAL IDENTIFICATION SYSTEM

FIELD

The application relates to systems for reproducing, or displaying, images, and more particularly, but not exclusively, to systems that reproduce images for the purpose of confirming provenance, or identity, of articles to which the images are attached, or of the materials that make up the images itself. The images may be formed using an optical surface having periodic surface structures. The application also relates to methods of making the optical surface and the use of said optical surface in anti-counterfeiting and/or security applications.

BACKGROUND

GB 2235287 discloses an optical sensor based on the use of surface plasmon polaritons (SPP). The sensor comprises apparatus for detecting an SPP resonance maximum which occurs following polarisation conversion of particular wavelengths of radiation incident upon a surface which correspond to the excitation of an SPP at or about its resonant frequency.

WO 98/37514, the contents of which are hereby incorporated by reference in their entirety, also makes use of the polarisation conversion effect. In WO 98/37514, a signature recognition system is disclosed comprising one or more suitably profiled diffraction gratings provided on an article, a source of polarised radiation, means for directing the source of polarised radiation onto the grating(s) at a suitable plane of incidence and means for detecting reflected radiation which is oppositely polarised to the incident radiation. WO 98/37514 discloses that the system can be used to distinguish effects at different wavelengths and/or provide identification codes such as bar codes. Bar code systems are well known as a means of distinguishing articles, but can easily be distorted by creases, scratches and so on. This can cause errors in the detection step.

There is a continued need for alternative and/or improved methods of marking and/or authenticating articles. In particular, it would be desirable to be able to provide articles which have visually appealing and/or hidden features, yet are tolerant to damage in everyday use.

SUMMARY

According to one aspect of the present invention there is provided a system comprising: an optical surface having a diffractive image generating structure disposed thereon, the diffractive image generating structure itself comprising a layer of reflective material incorporating a plurality of grooved diffractive elements each having a periodic wave surface profile, the periodic wave surface profiles each having a groove alignment direction;

a source of incident electromagnetic radiation arranged to illuminate the diffractive elements at an angle of incidence substantially normal to the plane of the surface of the diffractive elements;

means for polarising the radiation from the source, and means for polarising radiation reflected from the diffractive elements;

wherein the diffractive elements are configured such that, in use, polarisation conversion of the incident radiation takes place, and wherein the diffractive elements are disposed in a two dimensional array of pixels to represent an image; and further wherein the means for polarising is arranged to pass incident radiation having a polarisation state of approximately 45° azimuth to the groove alignment direction, and is arranged to select a polarisation, using the means for polarising the radiation reflected from the diffractive elements, and to pass radiation of the selected polarisation to a detection point.

Optional features of the above system are mentioned in dependent claims.

According to a second aspect of the present invention there is provided the use of a system of the kind mentioned above to determine whether or not an article is genuine or counterfeit.

According to a third aspect of the present invention there is provided an optical surface for use with a system of the kind mentioned above.

According to a fourth aspect of the present invention there is provided a banknote being, or provided with, an optical surface for use with a system of the kind mentioned above.

According to a fifth aspect of the present invention there is provided a method comprising:

(i) providing an optical surface having a diffractive image generating structure disposed thereon, the diffractive image generating structure itself comprising a layer of reflective material incorporating a plurality of grooved diffractive elements each having a periodic wave surface profile, the periodic wave surface profiles each having a groove alignment direction, wherein the diffractive elements are configured such that polarisation conversion of incident radiation takes place, and wherein the diffractive elements are disposed in a two dimensional array of pixels to represent an image;

(ii) illuminating the diffractive elements with electromagnetic radiation, the radiation being directed onto the diffractive elements at an angle of incidence substantially normal to the plane of the surface of the diffractive elements and having a polarisation state of approximately 45° azimuth to the groove alignment direction; and (iii) passing the radiation reflected from the diffractive elements through polarising means for selecting a polarisation and then passing radiation of the selected polarisation to a detection point.

According to a sixth aspect of the present invention there is provided the use of a method of the kind mentioned above to determine whether or not an object is genuine or counterfeit.

Various aspects of the present disclosure and embodiments thereof will now be outlined.

According to one aspect of the present disclosure, there is provided a system for reproducing an image, the system comprising:

an optical surface having at least one diffractive image generating structure disposed thereon, the diffractive image generating structure itself comprising a layer of reflective material incorporating a plurality of grooved diffractive elements each having a periodic wave surface profile, the periodic wave surface profiles each having a groove alignment direction;

a source of incident electromagnetic radiation arranged to illuminate the optical surface of the diffractive elements at an angle of incidence substantially normal to the plane of the surface of the diffractive elements;

means for polarising the radiation from the source, and means for polarising radiation reflected from the optical surface;

wherein the diffractive elements are configured such that polarisation conversion of the incident radiation takes place, and wherein the diffractive elements are disposed in a two dimensional array of pixels to represent an image; and further wherein the means for polarising is arranged to pass incident radiation having a polarisation state of approximately 45° to the groove alignment direction, and is arranged to select a polarisation, using the means for polarising the radiation reflected from the surface, and to pass radiation of the selected polarisation to a detection point.

Embodiments of the system may be used to identify an article, for example by comparison of an image produced by the system with a reference or expected image.

The article to be identified may be the optical surface on which the diffractive image generating structure is disposed upon, or may be a separate article to which the optical surface is attached. Identification comprises viewing the image according to the system and method disclosed herein, and confirming that the image seen matches with that expected. A sample of an expected image may advantageously be reproduced using e.g. standard printing techniques, so that a user may readily see whether the image viewed matches up. The identification relies on the fact that it will be difficult for another party to reproduce the diffractive pattern.

The system may be used to provide an identification marking that is generally covert under diffuse lighting and/or normal observation conditions, but becomes visible, or much more visible, when illuminated by polarised light under certain specified viewing conditions. The system comprises an optical surface that can be configured to provide a monochrome or coloured pattern or image, preferably a high resolution colour image (e.g. a picture). The pattern or image may comprise an array of pixels, with each pixel comprising an area having thereupon one or more grating structures. Also within the area comprising each pixel there may be one or more regions having no grating pattern. Some pixels may have no grating structure thereupon, for reasons that will be described in more detail below. The surface may be produced using relatively cheap and readily available materials. Ideally, a high resolution colour image (e.g. a picture) is implemented using sub-pixel rendering techniques.

It is known that when polarised electromagnetic radiation is directed to a suitably proportioned diffraction grating in a plane of incidence substantially normal to the plane of the surface of the diffraction grating and at an angle of approximately 45° azimuth to the alignment of the grooves on the surface of the diffraction grating (as described, for example, in WO 98/37514) the reflected radiation is oppositely polarised to the incident radiation.

The phenomenon is known as polarisation conversion, and the polarisation conversion effect is dependent on providing a diffractive surface that alters the state of incident radiation. The effect is due to the geometry of the surface and can be exhibited by any suitably profiled reflective material, the frequency range of operation being determined by the dimensions of that profile. As the effect is dependent on a close relationship between the geometric surface profile of the grating and the wavelength of radiation incident upon it, a particular grating can be configured to provide a specific spectral response when viewed through crossed polarizers.

Considering the case of linearly polarised radiation, a common coordinate system used to define the polarisation state uses the terms "p" and "s", defining orthogonal states. The coordinate system is defined with reference to a plane made by the direction of propagation of the radiation, and a vector normal to a reflecting surface. In the "p" state, the electric vector lies within the incident plane (i.e. is parallel to it), whilst in the "s" state the electric vector is perpendicular to that plane. A conversion of polarisation state by reflection from a suitable surface is denoted as $R_{ps}$ or $R_{sp}$. $R_{ps}$ refers to incident radiation in the p state that is converted to s state upon reflection, while $R_{sp}$ refers to incident radiation in the s state that is converted to p state upon reflection.

Note that herein the $R_{ps}$ conversion is discussed for convenience, but the normally skilled person will appreciate that the equivalent $R_{sp}$ conversion is equally applicable, and may be used in its place, and any reference to $R_{ps}$ should, where context permits, be taken to mean a polarisation conversion, which may be $R_{ps}$ or $R_{sp}$ conversion.

The teachings of this application have applicability also with circularly polarised light. Normally, when circularly polarised light of a given handedness reflects from a surface, the handedness of the reflected light is opposite to that of the incident light. However, if it undergoes a polarisation conversion by reflection from a suitable surface, then its handedness will be the same for both the incident and the reflected light.

In WO 98/37514, a grooved reflective surface exhibiting polarisation conversion is used in a signature recognition system for identifying an article. In one embodiment, monochromatic light is used to produce a signal from a grating or series of gratings that can only be detected if polarisation conversion has occurred. In another embodiment, polychromatic light is used in conjunction with different diffractive elements exhibiting different peak values of reflectivity to provide a high degree of distinguishability between elements. In both cases, the $R_{ps}$ peak wavelength provides the differentiating variable. The diffractive elements in WO 98/37514 may be configured as identification codes such as bar codes. WO 98/37514 does not contemplate the possibility of producing images (e.g. a picture) by the $R_{ps}$ technique.

Note that the terms "grating" and "diffractive element are used interchangeably herein, to represent one or more ridges or similar elements designed to diffract radiation of certain predefined wavelengths or wavelength ranges.

An optical surface may be provided comprising a reflective layer having a plurality of diffractive elements arranged in a two dimensional array, the elements being capable of producing a wavelength dependent $R_{ps}$ signal. The $R_{ps}$ response can be tailored by varying the properties of the grating element. As a result, different grating elements in the two dimensional array can have different $R_{ps}$ responses.

The periodic wave surface profile of each diffractive element can generally be defined as having a pitch G and a profile depth d. Typically, the pitch G is comparable to the wavelength $\lambda$ of polarised electromagnetic radiation incident upon the layer of reflective material.

The surface profile may be any suitable shape, such as, for example, a sine wave profile. However, in a preferred embodiment, the surface profile is a rectangular, square or pulsed form having a mark to space ratio M. For a square profile, this is the ratio of the length of the peak to that of the groove This type of profile lends itself to preferred manufacturing techniques, such as electron beam lithography. Another important advantage of using a rectangular, square or pulsed profile is that M provides an extra variable for optimisation of a reflected $R_{ps}$ colour response. In other words, the pitch G, depth d and/or M of each surface profile can be chosen to provide a particular colour response.

The plurality of diffractive elements may comprise grating elements having at least two different surface profiles, thereby providing at least two different $R_{ps}$ spectral responses (specifically colour responses) in the two dimensional array. If the optical surface is illuminated by polarised polychromatic radiation in the visible waveband, it will be apparent that the optical surface will exhibit at least two colour responses when viewed through crossed polarizers.

The diffractive elements having at least two different surface profiles may form a repeating/alternating pattern within the two dimensional array. The repeating pattern may be different in different directions through the array, or may be the same in different directions through the array. Suitable array patterns are a hexagonal arrangement or a grid arrangement. Preferably, the array pattern is suitable for enabling sub-pixel image rendering.

The diffractive elements may be arranged to have more than two different profiles. Each profile may, for example, be associated with a different colour. The two dimensional array of diffractive elements may be arranged to form an image with sub-pixel rendering, using any suitable sub-pixel rendering format. An optimum arrangement is an array with 3 different grating profiles, which enables colour rendering using 3 sub-pixels to be implemented, as described below in more detail.

The diffractive elements may alternatively be arranged to use pixels each having a single profile (as opposed to the pixels having three grating profiles—one per sub-pixel—as mentioned above), but wherein the number of different profiles is increased to provide that number of different colours. There may be, for example, 5, 10, 15 or 20 different profiles, so providing a choice of that many colours for each pixel in the image.

The grating may be arranged to have an array of pixels located thereon, with each pixel having diffractive properties that may differ from those of its neighbour. For example, each pixel may be adapted to impart a brightness or colour property to light reflected therefrom (when viewed in a suitable manner as explained herein) that is independent of properties of neighbouring pixels.

Each pixel may comprise a plurality of sub-pixels, where each sub-pixel is arranged to have properties independent from those of the other sub-pixels. In this manner each sub-pixel may be arranged to reflect e.g. a separate colour at a selected intensity. Thus the plurality of sub-pixels provide a means for giving the pixel of which they form a part a colour and brightness that is a combination of those of the sub-pixels. There may be three sub-pixels per pixel, arranged to favour reflectivity of red, green and blue colours respectively.

Each pixel or sub-pixel may contain, along with its respective grating structure, one or more regions having no grating structure present. These would therefore comprise of smooth areas that produce no $R_{ps}$ conversion, and so appear dark when viewed in some embodiments, and appear as the colour of the illuminating light in other embodiments, dependent upon the particular arrangement of polarisers. Some pixels or sub-pixels may comprise their entire regions of these non $R_{ps}$ conversion regions. These smooth regions, and the extent to which they make up the area of a pixel or sub-pixel, therefore may be used to control the apparent brightness of the pixel or sub-pixel. Advantageously, such regions may be used to control the brightness of individual colour components within a pixel, thereby increasing the number of colours available in a pixel's colour palette.

The array of pixels represent an image. The image may be viewed using a suitable arrangement of polarisation means. In one embodiment, a first polariser may be located so as to define the polarisation of light incident upon the grating comprising the array of pixels, and a second polariser, arranged to pass orthogonal radiation from that of the first polariser, may be located in the optical path between the grating and a viewer. This arrangement therefore provides an image to a viewer that is defined by light that is converted in polarisation by the grating structure. If the grating did not convert any light, then nothing would be seen (assuming perfect polariser performance), and the image would appear black.

Some embodiments may be arranged to use a single polarising means to both polarise light from the source, and to select a polarisation and pass radiation of the selected polarisation to the detection point. The polarising means may comprise one or more transmissive, reflective or absorptive polariser in any suitable combination or configuration.

Some embodiments may be arranged to select the $R_{ps}$ converted radiation to be passed to the detection point, such as those described above, whereas others may be arranged to select the polarisation orthogonal to the $R_{ps}$ converted radiation (i.e. the component of unconverted polarisation) to be passed to the detection point.

Embodiments adopting this latter approach may have a transmitting linear polariser arranged to block light that has been polarisation-converted by the grating, whilst allowing unconverted polarisation to pass. As a single polariser is employed, then light from an illumination source (which may be arbitrarily polarised on condition that it contains a component of light that will be passed to the grating by the polariser) will be seen reflected from the grating by the viewer, but, where the grating has converted the polarisation, the image will be darker, as that light will be stopped by the polariser on its return path. In this way pixels or sub-pixels may act to selectively reduce the intensity of particular colours of the light that are received by a viewer or detector, and so are able to project an image to the viewer or detector.

Some embodiments adopting the former approach, i.e. those that select the polarisation converted radiation, may utilise a single transmitting circular polariser instead of the single linear polariser in a similar manner, except that it is the converted signal from the grating that will be transmitted back through the polariser, whilst any unconverted components will be blocked.

As a further alternative, an embodiment may work functionally similar to the two-polariser arrangement described above, but wherein the first polariser is not present, and instead an already polarised source of light is used. Otherwise, the operation will be similar to that described.

The images produced according to certain embodiments are virtually invisible in standard diffuse white light, although they may be at least partially visible to some extent (e.g. when illuminated with certain colours) at grazing incidence with the light from a specific direction.

Ideally, the optical surface has grating elements with two to five different surface profiles.

Sub-pixel rendering is a known technique for producing colour images. Standard sub-pixel rendering formats may be used to create an $R_{ps}$ colour image. In a typical arrangement, a colour pixel in the $R_{ps}$ image is formed from three adjacent sub-pixels having chosen primary colours (e.g. red, green and blue—RGB). The colour of each sub-pixel is obtained by specifying a tailored grating design providing the required colour under the desired illumination conditions. The relative intensity of each polarisation-converted primary colour within a specific pixel may then be controlled by adjusting the area of the grating, with unused space typically being left as a flat reflective layer, such as a flat metal. The flat metal does not convert the polarisation and hence, appears black under the appropriate viewing conditions. In other words, it does not contribute to the reflected spectrum.

The pixels or sub-pixels can have any suitable shape in plan view, and respective diffractive elements may be the same or different. The shape is preferably selected from a circle, square, rectangle or hexagon. Respective grating elements are preferably the same shape.

The layer of reflective material may be formed from any suitable material such as, for example, a metal, metal alloy or metal ink. Preferably, the reflective material is a metal or metal alloy, more preferably a metal selected from the group consisting of aluminium and silver. Alternatively, the reflective material may be a reflective ink. The ink may be an ink containing metal particles.

The layer of reflective material may be coated with a protective or overcoat layer. If an overcoat layer is present, the refractive index of said layer is preferably taken into account when determining suitable surface wave profiles for the plurality of diffractive elements. Clearly, the overcoat layer should have good transparency at the wavelengths at which the gratings are designed to operate.

The optical surface maybe disposed on a substrate. Suitable substrates include paper, metal, or various polymers (such as polypropylene and polyester), silicon, glass or rubber etc. providing the substrate has or can receive a metallic upper surface that is thick enough to be opaque to the wavelengths of interest. Suitable metals include aluminium and silver, and the normally skilled person will realise that other metals may be suitable, and would understand that their suitability may be ascertained by experimentation, given knowledge of their complex permittivities in the wavelength regimes of interest.

The source of polarised electromagnetic radiation may be circularly or linearly polarised.

The source of electromagnetic radiation may be monochromatic or polychromatic, although it will be appreciated that if monochromatic radiation is used, then only monochromatic images may be produced.

Preferably, a two dimensional array of diffractive elements with surface profiles of differing dimensions are provided and the source of electromagnetic radiation is polychromatic.

The source of electromagnetic radiation is preferably visible light.

The optical surface can be disposed on an article, preferably an article selected from any one of a banknote, cheque, credit card, identity card, medical card, ticket, legal document, deed, label, casing or shrink-wrap.

It has been explained above that the diffractive elements are chosen to provide a particular colour or range of colours when used in a system of the type heretofore mentioned. However, an optimisation of design of the diffractive elements may be advantageous if a particular profile has optical properties that deviate from the desired range. Such optimisation may comprise a trial and error approach, or any other suitable design technique.

In general, the pitch G of the diffractive element(s) determines the peak wavelength of the reflection profile. In the absence of a protective, topcoat or overcoat layer, the pitch G may be selected to be comparable to the wavelength of illumination $\lambda$. However, if a topcoat having a refractive index i is present, the pitch G may be selected to be similar to the value $\lambda/i$.

The depth d of the profile is generally determinative of the strength of the $R_{ps}$ reflection. The skilled person will be aware that the $R_{ps}$ intensity increases with depth until an optimum is reached; thereafter the strength of reflectance decreases.

WO 98/37514 discloses that the depth to pitch ratio d/G is a key parameter in optimising the $R_{ps}$ response of diffractive elements. The present inventors have found, however, that mere selection of the depth to pitch ratio is not enough to achieve the desired colour response(s), at least in part because of the realisation that a good perceived colour response does not necessarily equate to the sharpest and/or most intense spectral response.

Instead, it has been found that the precise $R_{ps}$ spectral response of a grating under the specified orientation constraints can be dependent on a number of factors, including the pitch of the grating, the modulation depth, the Fourier harmonic content of the cross-sectional profile, the permittivity of the layer of reflective material at the wavelengths of interest and the permittivity of any optional additional protective or coating layer. By way of example, the fundamental plasmon resonance is excited at a spectral position that is determined by the grating pitch and the refractive index of a dielectric coating. The strength of coupling to the plasmon has a quadratic dependence upon grating depth, while the spectral width is determined by the damping of the resonance by re-radiation and absorption. Aluminium is a particularly suitable material for the reflective layer for a full-colour visible-light image because the wavelength dependence of its complex permittivity is such that it causes plasmon resonances of similar relative spectral shape to be excited across the visible spectrum by grating designs that are constrained by having the same modulation depth.

It follows that some or all of the above factors are advantageously optimised to provide a desired $R_{ps}$ colour response. In practice, however, the layer of reflective material having a broadly suitable permittivity is chosen for reasons of cost, manufacture and so on, and the various dimensions of the diffractive element are optimised to provide a desired colour response.

Preferably, the $R_{ps}$ response for a particular diffractive element is achieved by selecting an appropriate pitch G in combination with the depth d, mark, mark to space ratio M and/or mark to pitch ratio. This, in turn, can be achieved by the use of CIE colour calculations in combination with iterative optimisation methods, as discussed below. In the general case, and not just for rectangular grating structures, the spatial surface relief profile of the grating may be described by selection of appropriate Fourier components.

Spectrally-tailored diffractive elements may be produced by optimising the various surface dimensions. The tailored spectra may be defined as, but not limited to, three primary colours that define a gamut for accurate image reproduction in pixel arrays.

According to another aspect of the present disclosure, there is provided the use of a system described above to determine whether or not an article is genuine or counterfeit.

Embodiments may be used to generate any suitable image. A production run of articles may be arranged to have the same image on each one. For example, a print run of bank notes may be arranged to have a standard image of a figurehead etc. Alternatively, a set of articles may be arranged to have unique images thereon. For example, a print run of bank notes (particularly high denomination notes) may be arranged to have an image of the serial number of each note reproducible by the means described herein.

According to another aspect of the present disclosure, there is provided a method of reproducing an image comprising:

(i) providing one or more optical surfaces having at least one diffractive image generating structure disposed thereon, the diffractive image generating structure itself comprising a layer of reflective material incorporating a plurality of grooved diffractive elements having a periodic wave surface profile, and a groove direction, wherein the diffractive elements are configured such that polarisation conversion of the incident radiation takes place, and wherein the diffractive elements are disposed in a two dimensional array;

(ii) illuminating the one or more optical surfaces with electromagnetic radiation, the radiation being directing to the surface of the gratings at a plane of incidence substantially normal to the plane of the surface of the diffraction grating and at an angle of approximately 45° azimuth to the alignment of the grooves on the surface;

(iii) observing the optical surface(s) through a polarising means.

Typically, an image becomes visible at step (iii) whilst being substantially invisible at step (i).

The method may be used to determine whether or not an object is genuine or counterfeit, by comparing the appearance of the optical multilayer observed in step (iii) with a reference image. The reference image may be printed on the article using traditional printing methods.

The source of electromagnetic radiation may be visible light.

The reflective layer may be formed by any suitable method, such as sputtering.

The diffractive element is preferably formed by electron beam lithography.

BRIEF DESCRIPTION OF THE DRAWINGS

Embodiments of the present invention will now be described, by way of example only, with reference to the accompanying drawings, in which like reference numerals are used for like parts, and in which.

DETAILED DESCRIPTION

Figure 1A:
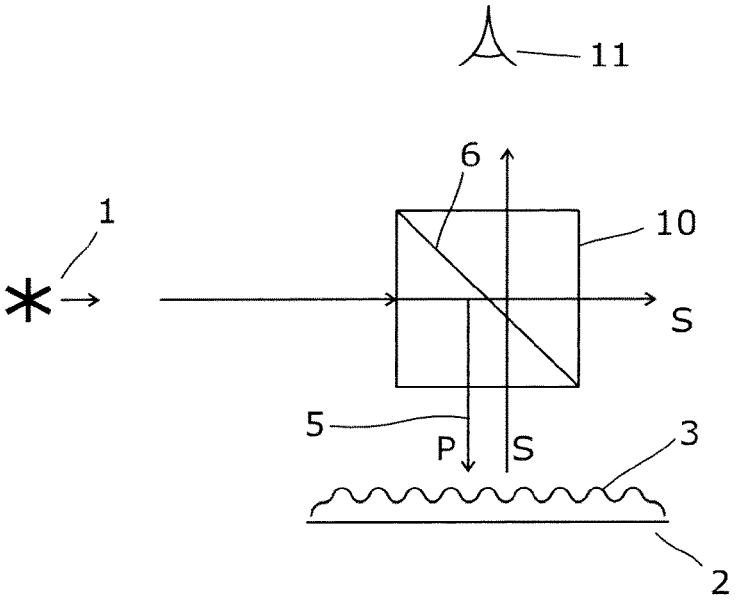
FIG. 1 shows the geometrical arrangement of components in an embodiment of the invention.
Figure 1B:
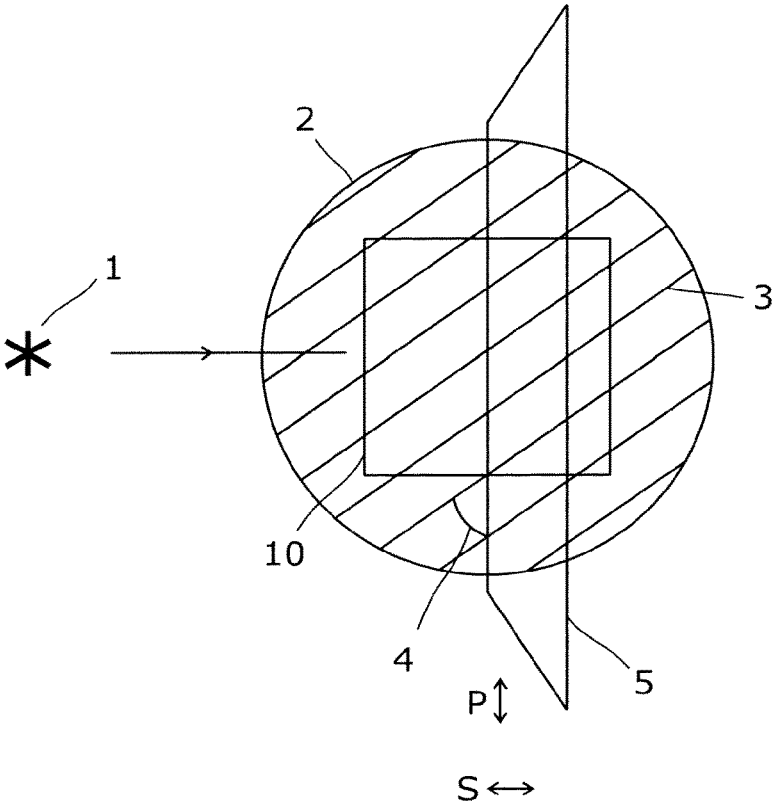

FIGS. 1*a* and 1*b* show schematically, in a profile view and a plan view respectively, a typical representation of how various components may be arranged in an embodiment of the invention. A grating (2) comprises a repeating pattern of grooves (3) comprising an array of regions, each one defining a pixel or sub-pixel of an image, and each being of a predetermined pitch and depth, as described herein, with the surface of the grating defining a plane. A plane of incidence (5) is defined, orthogonal to the plane of the grating. A polarising beamsplitter (10) is arranged to reflect light of a given polarisation (denoted "p") from an illumination source (1) orthogonally onto the grating (2), wherein the polarisation state p is parallel to the plane (5) and at 45° to the alignment of the grooves (3) The alignment of the plane of incidence (5) in relation to the grooves (3), therefore defines an azimuthal angle (4) of 45°, or π/4 radians.

The illumination source (1) may provide linearly polarised light, of polarisation state p, or it may provide unpolarised light. In the latter case, the light from the illuminator having a polarisation state orthogonal to state p (i.e. in state s) will pass through the polariser and has no further function. Linear polariser (6) within the polarising beamsplitter (10) is used to reflect the light of state p towards the grating (2).

Light hitting the grating (3) will undergo a polarisation conversion, $R_{ps}$, and reflected light will therefore be in the s polarisation state. This light passes up to the beam splitter (10) where it is able to pass through the polariser (6) due to the $R_{ps}$ conversion that has taken place, and on to an observer or detector (11).

To produce images having defined colours the pixels (or sub-pixels forming a given pixel) forming the image need to be adapted to produce the desired colour. In an embodiment of the invention this is done by suitable selection of the grating pitch, depth, and (for rectangular grating structures) mark/space ratio. These parameters may be devised by e.g. theoretical calculation, or by computer modelling, or an iterative trial-and-error approach, or by a combination of such methods.

Modelling of colours that may be produced by a given grating structure has been done. A finite-element method model was set up using Ansys Inc.'s HFSS program to simulate the spectral reflectances of grating profiles. Each spectrum was converted to the well-known CIE xyY coordinate system with the purpose of identifying a set of $R_{ps}$ RGB primary colours enclosing a broad gamut of chromaticities and efficient $R_{ps}$ conversion. A set of formulae was obtained to enable the conversion of CIE xyY coordinates of any colour to a set of $R_{ps}$ RGB relative intensities. By combining this conversion process with published conversion formulae relating CIE xyY to other standards, for example sRGB, the relative intensities of the pixels of a digital image recorded using that standard may be used to obtain an array of subpixel grating areas that perform $R_{ps}$ with accurate reproduction of the colours and the spatial distribution of the image.

FIG. 2 shows various modelled and measured results from a rectangular grating profiles formed in aluminium and silver.

Figure 2A:
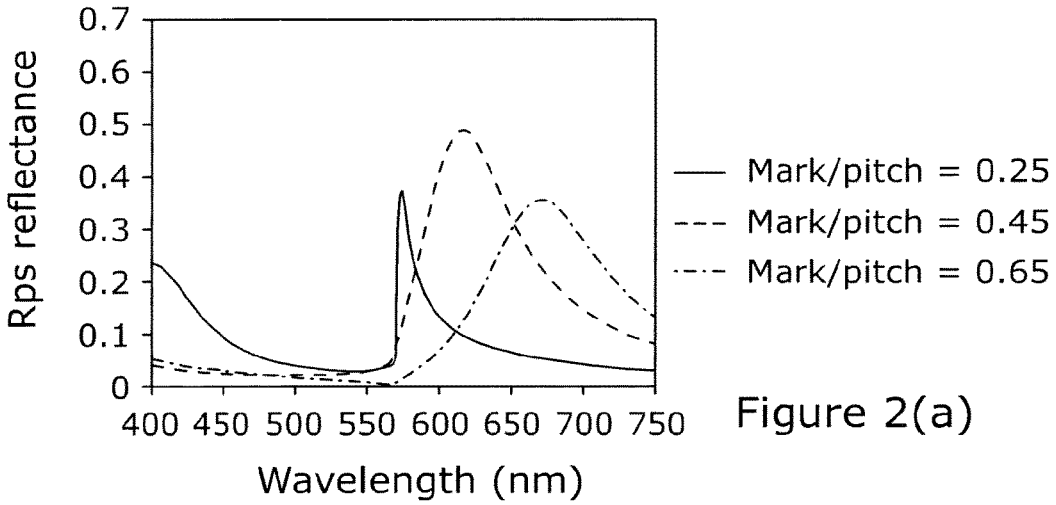
FIG. 2 shows modelled results of the $R_{ps}$ conversion spectrum for different values of the mark to pitch ratio and pitch for a grating with a rectangular profile.

FIG. 2*a* shows modelled results for aluminium of the $R_{ps}$ conversion of gratings having various mark to pitch ratios, each having a depth (peak to peak) of 45 nm and a pitch of 380 nm, encapsulated in a lossless transparent dielectric having a refractive index of 1.5. The wavelength-dependent permittivity of aluminium was specified in the model using the data of, A. D. Rakić, "Algorithm for the Determination of Intrinsic Optical Constants of Metal Films: Application to Aluminum," Appl. Opt. 34, pp. 4755-4767, 1995.

Table 1 presents the results of further modelling, showing pitch and mark/pitch parameters used to obtain red, green and blue colours, with a fixed grating depth of 45 nm. x, y and Y are the resultant CIE colour space parameters.

TABLE I

Grating dimensions and chromaticity data for selected $R_{ps}$ RGB primaries.

| $R_{ps}$ RGB Primary | Pitch (nm) | Mark/ pitch | x | y | Y |
|---|---|---|---|---|---|
| Red | 385 | 0.475 | 0.5968 | 0.3308 | 0.1074 |

TABLE I-continued

Grating dimensions and chromaticity data for selected $R_{ps}$ RGB primaries.

| $R_{ps}$ RGB Primary | Pitch (nm) | Mark/ pitch | x | y | Y |
|---|---|---|---|---|---|
| Green | 330 | 0.35 | 0.3327 | 0.5477 | 0.3197 |
| Blue | 275 | 0.3 | 0.2224 | 0.2047 | 0.1721 |

Figure 2B:
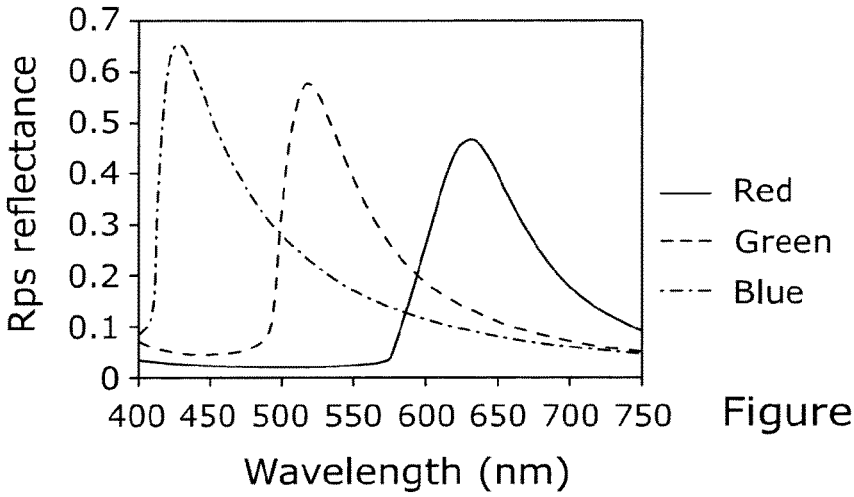

FIG. 2*b* shows modelled results of the $R_{ps}$ conversion for red, green and blue sub-pixel primaries based on the properties of aluminium. The modelling assumes the grating is being illuminated with linearly polarised broadband white light corresponding to the CIE standard illuminant E, with direction of illumination normal to the plane of the grating, and the groove alignment direction being at 45° to the plane of polarisation, e.g. using the setup shown in FIG. 1. Curve 40 shows the blue $R_{ps}$ conversion, curve 41 shows the green, while curve 42 shows the red.

Figure 2C:
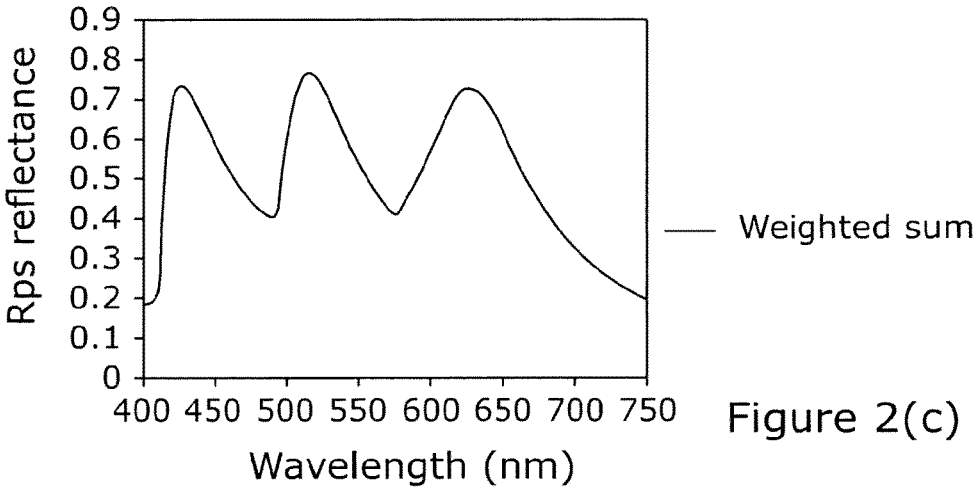

FIG. 2*c* shows a modelled $R_{ps}$ spectrum of a white pixel, comprising a combination of three sub-pixels, each comprising a separate colour from the three colour primaries shown in FIG. 4*a*. The simulation includes an area weighting of the sub-pixels in order to reproduce the white point of the CIE standard illuminant E. The respective weightings applied in the model were $N_{RED}$=1.1065, $N_{GREEN}$=0.8817, $N_{BLUE}$=1.0118.

Figure 3A:
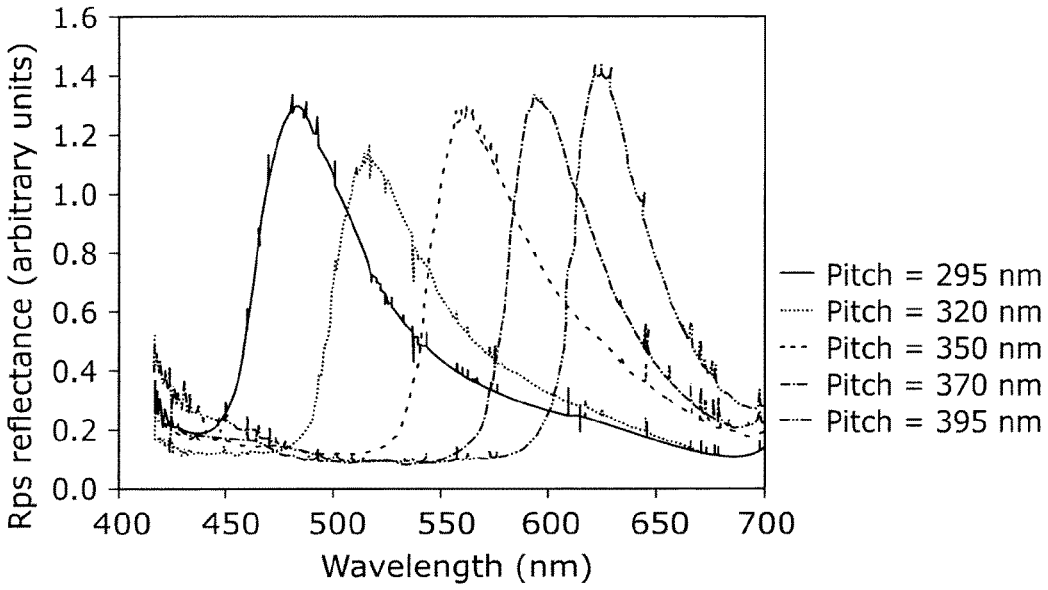
FIG. 3 shows actual measured results for gratings made in aluminium and silver.

FIG. 3*a* shows measured $R_{ps}$ reflectance v wavelength data taken from various aluminium gratings, with pitch values of 295 nm, 320 nm, 350 nm, 370 nm and 395 nm, for the curves peaking from left to right, and their mark/space ratios were 0.34, 0.33, 0.35, 0.37 and 0.39 respectively. The depths of the gratings was 45 nm.

Figure 3B:
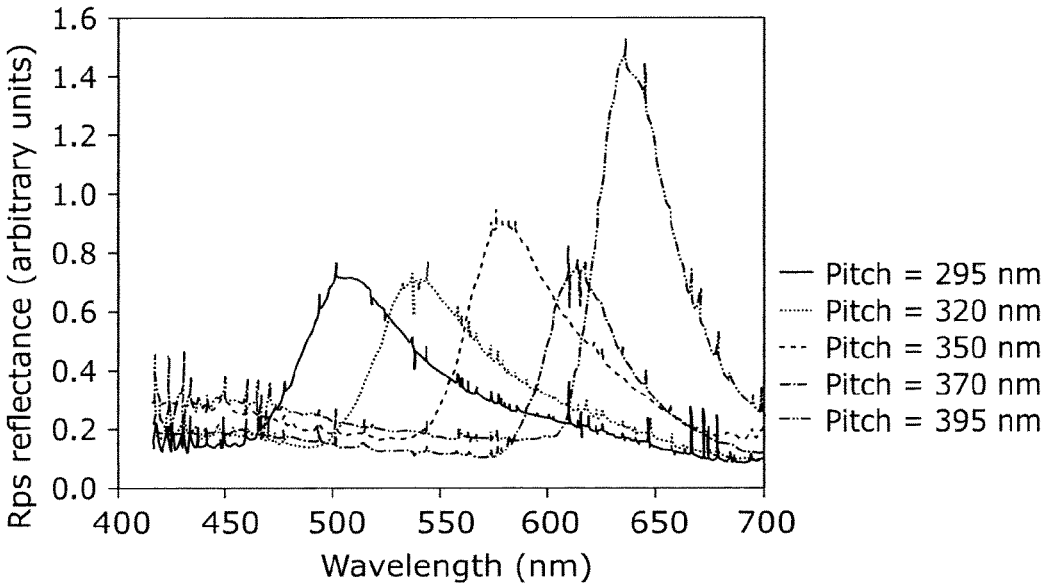

FIG. 3*b* shows measured $R_{ps}$ reflectance v wavelength data from various silver gratings, with all dimensions the same as in FIG. 3*a*. It will be observed that the reflectance varies more widely for these gratings as compared to those made in aluminium, but this can be taken into account by weighting the areas of sub-pixels and non-$R_{ps}$ conversion regions, to achieve a more complete colour range.

These primaries can then be used to produce concealed images using $R_{ps}$, pixels comprising three sub-pixels, each providing a different primary colour and having the corresponding grating design contained in adjacent rectangular areas. The relative intensity of each polarisation-converted primary colour within a specific pixel may be controlled by adjusting the area of the grating, with unused space being left as flat metal. The flat metal does not convert the polarisation and therefore appears black under the appropriate viewing conditions and does not contribute to the reflected spectrum.

The arrangement of subpixels may be used to reproduce colours as they would appear under a particular illuminant spectrum. The illuminant may be chosen according to a particular requirement. Conveniently, the CIE standard illuminant E may be chosen, which has a flat spectral power distribution across visible wavelengths, and a corresponding white point with CIE chromaticity values x=0.333 and y=0.333. In order to reproduce the white point, the areas of the individual primary colours may be weighted to take account of the reflectivities and chromaticities of the individual primary colours. Alternatively or as well, areas within a sub-pixel may be arranged to not have a grating structure formed thereon (e.g. by comprising of smooth metal), and so may be used to adjust the apparent brightness of the sub-pixel.

The grating design for each of the $R_{ps}$ primary colours was established by an iterative process. Firstly, the simulation of the electromagnetic response of a candidate grating design was performed to obtain its $R_{ps}$ spectrum, from which the CIE xyY coordinates were calculated. The available design parameters were then adjusted iteratively to alter the $R_{ps}$ spectrum through the plasmon behaviour, in order to optimise the xyY values for maximised colour saturation and reflectance magnitude. In this way, designs were obtained to provide $R_{ps}$ RGB primary colours enclosing a broad gamut of chromaticities and offering efficient $R_{ps}$ conversion.

An image has been produced using the technique describe herein to prove the principle. The image was a digital photograph in JPEG format of the Mona Lisa by Leonardo Da Vinci. Analysis of the CIE coordinates of the image showed that its RGB values fitted the gamut of the sRGB standard and accordingly, the data were treated as sRGB. These pixel data were extracted from the file as a matrix of values, which were then converted to $R_{ps}$ RGB values, which in turn were used to generate a layout file in GDS II format defining a pixel array containing area-weighted gratings. The weightings were calculated to reproduce the colours of the image when illuminated by the CIE standard illuminant E, which corresponds to a flat spectral power distribution across visible wavelengths.

The layout was written into a 45 nm thick layer of polymethylmethacrylate (PMMA) resist on a silicon substrate, and developed and processed using standard techniques. The resulting metal surface was encapsulated by bonding a glass superstrate using Norland NOA65 epoxy, which has a refractive index of 1.52.

Figure 4:
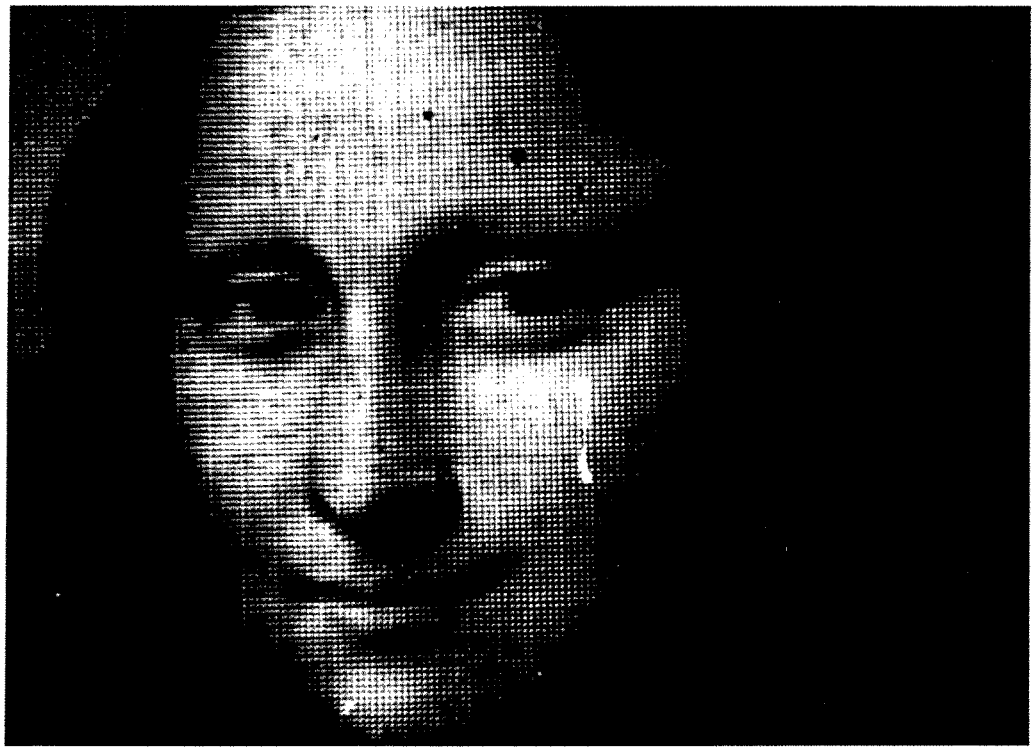
FIG. 4 shows an image of the Mona Lisa produced using an embodiment of the invention.

The $R_{ps}$ spectra of the fabricated test patches were measured using a polarising microscope, with the illumination and viewing paths containing linear polarisers set orthogonally to each other, and the grating vector of the sample orientated at the intermediate 45° angle. The microscope was fitted with a broadband optical source and a fibre-coupled optical spectrometer. The $R_{ps}$ image of the Mona Lisa sample was measured with the spectrometer arrangement replaced by a camera, and a black and white rendition of the resulting image is shown in FIG. 4. Of course, the original is in colour.

The grating profile used for each colour (i.e. sub-pixel) in the production of FIG. 4 was rectangular with a 45 nm peak to trough depth, and the grating was designed to work with an overcoat of refractive index 1.5. Three sub-pixels were used per pixel, each having the following respective characteristics:

Red sub-pixel: Pitch 385 nm, mark/pitch ratio 0.475 (i.e. width of grating peak as a fraction of the pitch)

Green sub-pixel: Pitch 330 nm, mark/pitch ratio 0.35

Blue sub-pixel: Pitch 275 nm, mark/pitch ratio 0.3

The values used therefore for the gratings were the same as those shown in Table 1.

Figure 5:
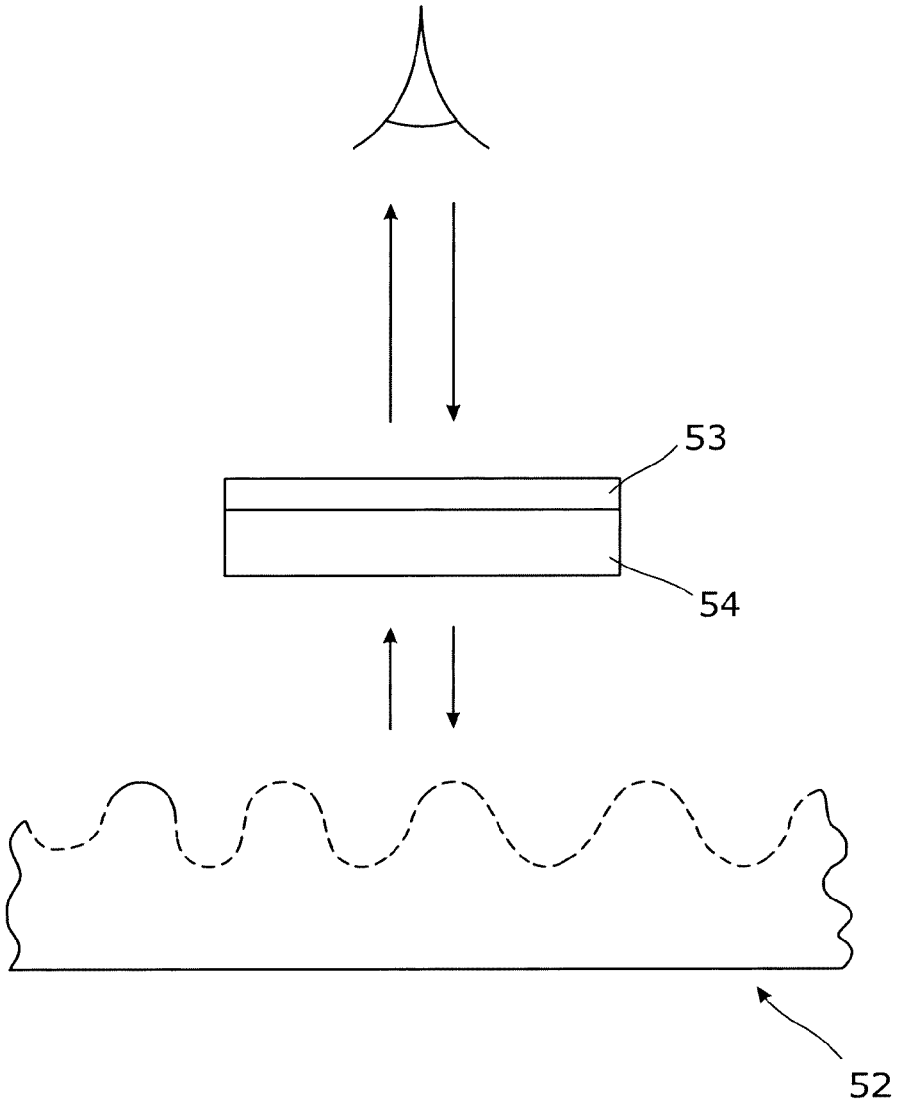
FIG. 5 shows an alternative embodiment of the invention adapted to use circular polarisation.

FIG. 5 shows an alternative embodiment of the invention that uses circular polarisation, instead of the linear polarisation discussed in embodiments described above. In FIG. 5, electromagnetic radiation comprising ambient light is arranged to illuminate a diffraction grating surface (52) from a direction substantially normal thereto, via a circular polariser. The circular polariser comprises a linear polariser (53), followed by a 90° phase-retardation plate (54), arranged with its principal axes orientated at ±45° azimuth to that of the linear polariser, the combination of (53) and (54) acting as said circular polariser. This arrangement filters the incident light so as to transmit only circularly polarised light. The circular polariser may be configured so that the transmitted light is either left-hand circular or right-hand circular. Light that is reflected from the surface is filtered by a return pass through the circular polariser. On the return pass, the circular polariser only passes circularly polarised light of the same handedness as that transmitted on the forward pass, converting it to a linear polarisation in the process. The radiation from the source, having been circularly polarised, arrives at the diffraction grating surface (52) on the article under detection. The circular polarisation may be resolved into two orthogonal linear components of equal amplitude, orientated at +45° and −45° respectively to the grating azimuth, whereby one component lags the other in phase by 90°. Both linear components undergo polarisation conversion due to the grating, so that the phase relation with respect to the selected axes is reversed. Taken in combination with the mirror reversal on reflection, this process results in the preservation of the circular polarisation handedness: the reflected beam can then be transmitted back through the circular polariser, and viewed by an observer or optical detector. If polarisation conversion did not occur (i.e.) if the correctly-profiled grating was absent) then the reflected radiation would be rotating in a sense that would be opposed to that of the polariser, and transmission could not occur. The reflected radiation will therefore only produce a signal visible to an observer or detector if the surface exhibits specifically-tailored diffractive properties.

A modification to the embodiment shown in FIG. 5 may comprise a similar arrangement, but wherein a broadband source of light is provided as an illumination source. This takes away a reliance upon there being sufficient ambient light in any given situation.

The embodiment of FIG. 5 could be employed, for example, on a document or article, wherein the grating (52) is located on one part of the document, while the polariser elements (53, 54) are located on another part, and wherein the different parts could be brought into the configuration shown in FIG. 5, e.g. by bending or folding the document appropriately. Thus such an article provides a convenient means for checking its authenticity without requirement for further optical components, by ensuring for example that the resulting image matches an expected image, such as a similar, but traditionally printed image located close thereto.

A further degree of resolution can be obtained by arranging two detectors in parallel, one detecting polarisation converted reflections, the other detecting remaining reflections. A comparison of the two detected signals provides a higher resolution measurement of the polarisation converted radiation.

Aspects and embodiments of the invention extend to a method substantially as herein described, with reference to the accompanying drawings.

Aspects and embodiments of the invention have been described with specific reference to the production of images in the visible waveband. It will be understood that this is not intended to be limiting and that aspects and embodiments of the invention may be used more generally at other wavelengths of electromagnetic radiation. Moreover, aspects and embodiments of the invention have been described in relation to hidden images, covert and anti-counterfeiting applications. This is not intended to be limiting, and other applications will occur to the skilled person.

The invention claimed is:

1. A system comprising:

an optical surface having a diffractive image generating structure disposed thereon, the diffractive image generating structure itself comprising a layer of reflective material incorporating a plurality of grooved diffractive elements each having a periodic wave surface profile, the periodic wave surface profiles each having a groove alignment direction;

a source of incident electromagnetic radiation arranged to illuminate the diffractive elements at an angle of incidence substantially normal to the plane of the surface of the diffractive elements;

a polariser for polarising the radiation from the source, and a polariser for polarising radiation reflected from the diffractive elements;

wherein the diffractive elements are configured such that, in use, polarisation conversion of the incident radiation takes place, and wherein the diffractive elements are disposed in a two dimensional array of pixels to represent an image, wherein the polarisers for polarising are arranged to pass incident radiation having a polarisation state of approximately 45° azimuth to the groove alignment direction, and are arranged to select a polarisation, using the polariser for polarising the radiation reflected from the diffractive elements, and to pass radiation of the selected polarisation to a detection point and wherein the surface profile is a rectangular, square or pulsed waveform having a mark to space ratio M, and wherein for each respective surface profile at least one parameter thereof is chosen to provide a particular colour response, the at least one parameter being selected from a list comprising the pitch G, depth d, mark, mark to pitch ratio, mark to space ratio M, Fourier harmonic content of the surface profile cross-section, permittivity of the layer of reflective material and permittivity of any protective coating layer.

2. A system as claimed in claim 1, wherein the selected polarisation is that which has been polarisation-converted by the diffractive elements.

3. A system as claimed in claim 2, wherein the polariser for polarising the radiation from the source, and for polarising the reflected radiation, comprises a single linear polariser arranged to reflect light from the source orthogonally towards the optical surface, and to pass orthogonally polarised light reflected from the optical surface.

4. A system as claimed in claim 1, wherein the polariser for polarising the radiation from the source comprises a linear polariser arranged to pass radiation from the source of radiation having a first polarisation state, and wherein the polariser for polarising the radiation reflected from the optical surface comprises a linear polariser arranged to pass the reflected radiation having a second polarisation state orthogonal to the first.

5. A system as claimed in claim 1, wherein the polariser for polarising the radiation from the source, and for polarising the reflected radiation, comprises a circular polariser.

6. A system as claimed in claim 1, wherein the selected polarisation is that which has not been polarisation-converted by the diffractive elements.

7. A system according to claim 1, wherein the periodic wave surface profiles have a common groove alignment direction and/or wherein the periodic wave surface profile of each diffractive element has a pitch G and a profile depth d, and wherein the pitch G is comparable to the wavelength $\lambda$ of polarised electromagnetic radiation incident upon the layer of reflective material.

8. A system according to claim 1, wherein the plurality of diffractive elements each have at least two different surface profiles so as to provide at least two different colour responses, and preferably 3 different surface profiles.

9. A system according to claim 1, wherein at least one of the pixels is arranged to have at least part of its surface area devoid of a grating structure.

10. A system according to claim 1, wherein the two dimensional array of diffractive elements is arranged to represent an image with sub-pixel rendering.

11. A system according to claim 1, wherein the surface area of respective diffractive elements is varied to provide differences in the perceived respective polarisation conversion intensity.

12. A system according to claim 1, wherein the reflective material comprises a metal or an alloy, and the metal is selected from the group consisting of aluminum and silver.

13. A system according to claim 1, wherein the layer of reflective material is coated with a protective layer, and/or wherein the reflective layer is disposed on a substrate layer.

14. A system according to claim 1, wherein the source of electromagnetic radiation is at least one of the following:

i) polychromatic;

ii) visible light;

iii) ambient light.

15. A system according to claim 1, wherein at least part of the polariser for polarising the incident radiation comprises the illumination source being arranged to emit polarised radiation.

16. A system according to claim 1, wherein the optical surface comprises or is disposed on an article selected from any one of a banknote, cheque, credit card, identity card, medical card, ticket, legal document, deed, label, casing or shrink-wrap.

17. A system as claimed in claim 1, wherein the system further includes a detector for detecting radiation reflected from the reflective layer.

18. A method comprising:

(i) providing an optical surface having a diffractive image generating structure disposed thereon, the diffractive image generating structure itself comprising a layer of reflective material incorporating a plurality of grooved diffractive elements each having a periodic wave surface profile, the periodic wave surface profiles each having a groove alignment direction, wherein the diffractive elements are configured such that polarisation conversion of incident radiation takes place, and wherein the diffractive elements are disposed in a two dimensional array of pixels to represent an image and wherein the surface profile is a rectangular, square or pulsed waveform having a mark to space ratio M, and wherein for each respective surface profile at least one parameter thereof is chosen to provide a particular colour response, the at least one parameter being selected from a list comprising the pitch G, depth d, mark, mark to pitch ratio, mark to space ratio M, Fourier harmonic content of the surface profile cross-section, permittivity of the layer of reflective material and permittivity of any protective coating layer;

(ii) illuminating the diffractive elements with electromagnetic radiation, the radiation being directed onto the diffractive elements at an angle of incidence substantially normal to the plane of the surface of the diffractive elements and having a polarisation state of approximately 45° azimuth to the groove alignment direction; and (iii) passing the radiation reflected from the diffractive elements through a polarizer for selecting a polarisation and then passing radiation of the selected polarisation to a detection point.

19. A method according to claim 18 further comprising comparing the appearance of an image generated using the reflected radiation received at the detection point in step (iii) with a reference image so as to determine whether or not an object is genuine or counterfeit.

* * * * *